US009013853B2

(12) United States Patent
Sheng et al.

(10) Patent No.: US 9,013,853 B2
(45) Date of Patent: Apr. 21, 2015

(54) DIRECT CURRENT BREAKER AND ELECTRICAL POWER SYSTEM COMPRISING SUCH DIRECT CURRENT BREAKER

(75) Inventors: Baoliang Sheng, Ludvika (SE); Andreas Bergvall, Gothenberg (SE); Björn Jacobson, Grängesberg (SE); Peter Klee, Ludvika (SE)

(73) Assignee: ABB Technology AG, Zürich (CH)

( * ) Notice: Subject to any disclaimer, the term of this patent is extended or adjusted under 35 U.S.C. 154(b) by 0 days.

(21) Appl. No.: 14/353,914

(22) PCT Filed: Oct. 25, 2011

(86) PCT No.: PCT/EP2011/068644
§ 371 (c)(1),
(2), (4) Date: May 5, 2014

(87) PCT Pub. No.: WO2013/060359
PCT Pub. Date: May 2, 2013

(65) Prior Publication Data

US 2014/0268468 A1 Sep. 18, 2014

(51) Int. Cl.
*H01H 33/59* (2006.01)
*H01H 17/12* (2006.01)
*H01J 17/12* (2006.01)

(52) U.S. Cl.
CPC ..... *H01H 33/596* (2013.01); *H01J 17/12* (2013.01)

(58) Field of Classification Search
CPC ..... H01H 33/596; H01J 17/12
USPC ..... 361/115
See application file for complete search history.

(56) References Cited

U.S. PATENT DOCUMENTS

| | | | | |
|---|---|---|---|---|
| 3,379,929 | A * | 4/1968 | Breitholtz | 315/59 |
| 3,548,256 | A | 12/1970 | Barkan et al. | |
| 3,557,382 | A | 1/1971 | Kotos | |
| 4,483,013 | A * | 11/1984 | Sato | 378/112 |
| 2012/0081097 | A1 * | 4/2012 | Birnbach | 323/304 |

FOREIGN PATENT DOCUMENTS

EP 0 178 733 A2 4/1986

* cited by examiner

*Primary Examiner* — Scott Bauer
(74) *Attorney, Agent, or Firm* — Birch, Stewart, Kolasch & Birch, LLP

(57) ABSTRACT

A direct current breaker for a high voltage direct current application includes: two high voltage electron tubes arranged in an anti-parallel connection, and a control circuit for receiving, from a control system, infrared pulses including control information, the control circuit further including a device configured to convert the infrared pulses into electrical control signals, for controlling a switching status of the direct current breaker. An electrical power system includes such direct current breaker.

20 Claims, 2 Drawing Sheets

DIRECT CURRENT BREAKER AND ELECTRICAL POWER SYSTEM COMPRISING SUCH DIRECT CURRENT BREAKER

FIELD OF THE INVENTION

The invention relates generally to the field of protection in direct current transmission and distribution systems, and in particular to direct current breakers in such transmission and distribution systems.

BACKGROUND OF THE INVENTION

High Voltage Direct Current (HVDC) transmission systems comprise an interesting alternative to alternating current ditto, and are under development. A difficulty when developing HVDC systems, and in particular when designing HVDC grids, is the provision of breakers that are able to break the high voltage direct current. Mechanical switches suffer from long response times, i.e. they are simply too slow to meet various requirements. Further, arcing may be another difficulty of such mechanical switches and has to be taken into consideration. Further, the time to clear a fault may be very long, which may be accounted for by over dimensioning components so that they are able to withstand fault currents and/or fault voltages for a prolonged duration. Over dimensioning of components in a power system however translates into increased costs and often also into larger footprint requirements.

Semiconductor-based switches are fast and could be used for HVDC applications. However, a large number of semiconductor devices would be required for the high voltages and currents, which would again give an expensive solution and which would typically require a large footprint.

The use of electron tubes, based on vacuum technology, has been discussed over the years as an alternative, and recently, cold cathode electron tubes able to withstand high voltages and currents have drawn attention. The use of electron tubes in high voltage direct current applications requires various considerations.

SUMMARY OF THE INVENTION

An object of the invention is to provide a direct current breaker able to break high currents and being adapted for use in existing electrical power systems.

The object is according to a first aspect of the invention achieved by a direct current breaker for a high voltage direct current application. The direct current breaker comprises two high voltage electron tubes arranged in an anti-parallel connection, and a control circuit for receiving, from a control system, infrared pulses comprising control information, the control circuit further comprising means for converting the infrared pulses into electrical control signals, for controlling a switching status of the direct current breaker.

The present invention provides an improved protection of converters by introducing DC pole breakers on its DC side, in addition to existing ac breakers on its AC side.

In an embodiment, the direct current breaker comprises two or more of the two high voltage electron tubes arranged in an anti-parallel connection connected in series. The use of at least two pairs of the high voltage electron tubes is advantageous in that it provides redundancy in case of failure of either one.

In an embodiment, the control circuit comprises an input device for receiving electrical power from an external power source.

In a variation of the above embodiment, the input device is arranged to convert AC power to a DC power or DC power to AC power needed by the control circuit.

In an embodiment, the high voltage electron tubes comprise cold cathode electron tubes.

In an embodiment, the high voltage current application comprises interruption of fault current of a voltage source converter or a thyristor based line commutated converter of an electrical power system.

The object is according to a second aspect of the invention achieved by electrical power system comprising a voltage source converter or line commutated converter and DC transmission lines. The electrical power system further comprises at least one direct current breaker as defined above, wherein the direct current breaker is connected at one end to the voltage source converter or line commutated converter and at another end to the transmission line.

In an embodiment, the electrical power system further comprises a power source for supplying the direct current breaker with electrical power enabling conversion of infrared signals into electrical control signals.

Further features and advantages of the invention will become clear upon reading the following description and the accompanying drawings.

DETAILED DESCRIPTION OF EMBODIMENTS

In the following description, for purposes of explanation and not limitation, specific details are set forth such as particular architectures, interfaces, techniques, etc. in order to provide a thorough understanding of the invention. In other instances, detailed descriptions of well-known devices, circuits, and methods are omitted so as not to obscure the description of the invention with unnecessary detail. Like numbers refer to like elements throughout the description.

Figure 1:
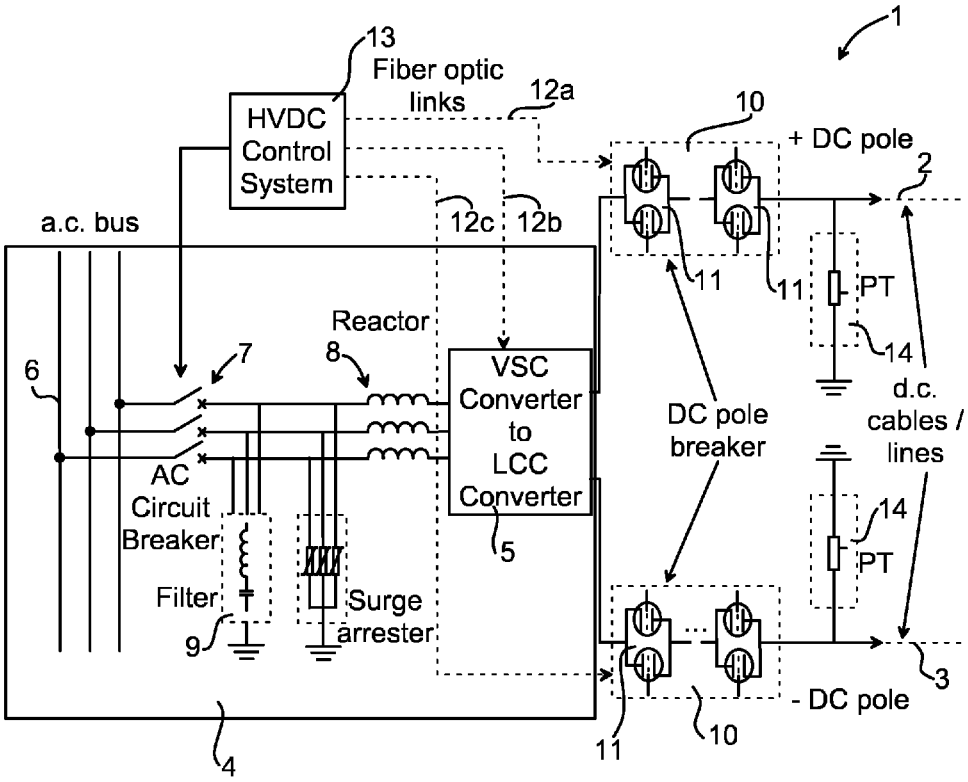
FIG. 1 illustrates schematically an environment in which embodiments of the invention may be implemented.

FIG. 1 illustrates an environment in which embodiments of the invention may be implemented. In particular, FIG. 1 illustrates an electrical power system 1 comprising a converter station 4 for converting AC power (alternating current/voltage) to DC power (direct current/voltage) before transmission over HVDC transmission lines 2, 3. The DC power is then converted back to AC power at another end of the HVDC transmission lines 2, 3 (not illustrated) for supply to end users.

In the FIG. 1, a bipolar HVDC transmission technique is illustrated. A bipolar HVDC transmission system can be considered as two single pole transmission systems, each such single pole transmission system having a respective transmission line 2, 3, one being positive 2 and the other negative 3. The bipolar HVDC transmission system thus comprises two transmission lines 2, 3, one positive (+DC pole) and one negative (−DC pole), which poles can be used independently and thus offering the advantage that one of the poles can continue to transmit power in case the other one is out of service.

The converter station 4 comprises a voltage source converter (VSC) 5 or a thyristor based line commutated converter (LCC) for accomplishing the conversion from AC to DC power, and vice versa. In the following the converter 5 is exemplified by a VSC, but the invention is not restricted to such converter and could as noted instead be a line commutated converter. The voltage source converter 5 is connected at its AC side to an ac bus 6, via phase reactors 8. The phase reactors 8 are arranged to control the active and reactive power by regulating currents through them, and function also as ac filters reducing high frequency harmonic contents on the ac currents caused by the switching operation of the voltage source converter 5. The phase reactors 8 provide e.g. low-pass filtering in order to provide a desired fundamental frequency voltage. The converter station 4 also comprises ac filters 9, the function of which is to eliminate harmonic content of the output ac voltage.

The converter station 4 further comprises AC circuit breakers 7, one for each phase. The AC circuit breakers 7 are used for isolating the HVDC system from the AC system when the HVDC system is malfunctioning, i.e. upon detection of a fault. Today, the system protection is accomplished only by means of the AC circuit breakers 7, provided on the ac-side. The present invention provides an improvement in this regards by introducing DC pole breakers 10 for protection of the converter station 4, and in particular the voltage source converter 5, also on the DC side.

In an embodiment, the DC pole breaker 10 comprises a single high voltage electron tube pair 11 arranged in an anti-parallel connection. By means of this set-up a bi-directional fault current breaking is enabled. The anti-parallel connection of electron tubes is advantageous in VSC HVDC systems, in which current flow direction can be changed in order to control the power flow in the electrical system.

The anti-parallel connection of electron tubes is fulfilled by internal construction of electron tubes or external mechanical connection. In the later case the anode and cathode of one electron tube are linked to the cathode and anode of another electron tube respectively by means of conductor bar. Each electron tube of the electron tube pair 11 comprises its own auxiliary control circuit 15. This control circuit 15 is terminated to the cathode.

In other embodiments, there are several high voltage electron tube pairs 11 connected in series, e.g. 2, 3, 4, . . . , or n series-connected electron tube pairs 11. It is advantageous to use at least two pairs of the high voltage electron tubes 11, for providing redundancy in case of failure of either one.

Each DC pole is provided with such DC pole breaker 10. The DC pole breaker 10 is connected on the transmission line 2, 3 so as to enable breaking of the current upon fault detection and thereby protecting the voltage source converter 5.

A control circuit 15 is, as mentioned, provided for each electron tube of an electron tube pair 11. The control circuits 15 are provided for controlling the switching status of DC pole breaker 10. The control circuit 15 communicates with a central DC control system 13 via light signals through fiber optic links 12*a* and converts the light command signals into electric commands to the DC pole breaker 10.

The control circuit 15 may comprise an intelligent electronic device (IED) that receives data from the central DC control system 13. The control circuit 15 is arranged to issue control commands, such as tripping commands for tripping circuit breakers, e.g. DC breakers 10, if the central DC control system 13 detects voltage and/or current anomalies in DC systems. The control circuit 15 may also issue control commands to DC breakers 10 for normal switching of systems.

The IED executes specific application functions on a platform which comprises hardware and firmware. The hardware platform typically comprises an analog handling part, for example transformer modules or A/D conversion, and provides input presented to a main Central Processing Unit/Digital Signal Processor (CPU/DSP) for processing. The main CPU/DSP is where the application functions are executed in the run-time environment. Binary status data from devices of the electric power system 1 is transferred via binary input modules to the CPU/DSP for processing and logical computation. The commands to the process, for example a process such as opening and closing of a circuit breaker, are performed via binary output modules. All input/output modules either of analog or Boolean type communicates with the main CPU/DSP via a communication backplane. In addition, the IED can support a local machine interface screen, communication ports and time synchronization ports.

In order to communicate with the various devices, e.g. the central DC control system 13, some communication means are provided. In the following, such communication means are exemplified by fiber optic links 12*a*, 12*b*, 12*c*.

Figure 2:
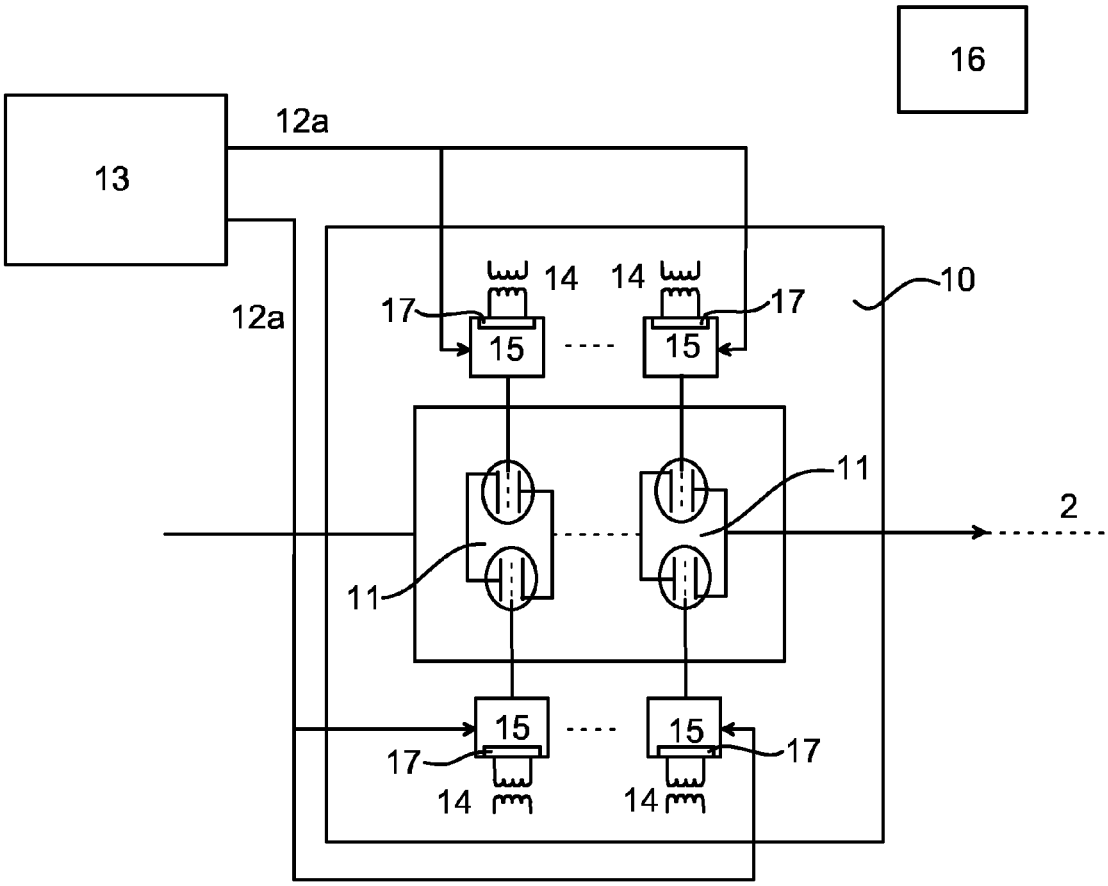
FIG. 2 illustrates a electron (vacuum) tube based breaker in accordance with an embodiment of the invention.

FIG. 2 illustrates the DC pole breaker 10, the central DC control system 13 and the fiber optic link 12*a* connected between them. In particular, the fiber optic link 12*a* is connected at one end to the control system 13 and at the other end to each control circuit 15 of the respective electron tubes of the DC pole breaker 10. Infrared (IR) pulses comprising control information are sent over the fiber optic link 12*a*. The control circuit 15 is arranged to transform the IR pulses sent by the control system 13 over the fiber optic link 12*a* into electrical control signals for controlling the electron tube pairs 11. To this end, the control circuit 15 comprises, inter alia, an optical receiver, e.g. including a photo detector that is arranged to receive the IR pulses and convert them into electrical control signals.

The IR pulses need to be transformed into electrical control signals in the order of kV, which is much higher than the electrical control signals that are used to control the other devices of the electrical power system 1, such as the ac breakers 7. Adaptations are therefore needed in this regards. In particular, today, electrical control signals of a low voltage (e.g. a few hundreds of volts) is used to control ac breakers 7 or mechanical type DC breakers.

The electrical control signal (e.g. a few volts) from central DC control system 13 is converted into light signal, and transmitted via fiber optic links 12*a* to high (pole) potential. The light signal is then converted back to an electric control signal. This electric control signal is amplified to a level which can control the electron tube pairs (e.g. a few hundreds volts). This amplification is performed in the control circuit 15.

Electrical power needs to be supplied to the control circuits 15 for accomplishing the amplification of the electrical control signals.

In an embodiment, a high frequency voltage transformer 14 comprises an external power source constituting the required power supply. The high frequency voltage transformer 14 is arranged to provide the electrical power needed for the electrical control signals for opening and/or closing the DC pole breaker 10, as illustrated schematically in FIG. 2.

In another embodiment, another external power source, schematically illustrated at reference numeral 16, is used. For example, a battery could be used. In still another embodiment, the required electrical power is taken from the transmission lines 2, 3.

The control circuit 15 comprises an input device 17 for receiving the electrical power from the external power source. This input device 17 is arranged to convert the AC power supply from 14 into a DC voltage needed by the control circuit 15. The input device 17 is further arranged to convert DC power to AC power.

All the electron tube pairs 11 of the DC pole breaker 10 need to be controlled, and the control circuit 15 comprises means for enabling this. Depending on the DC current flow direction one electron tube is active and the other anti-parallel connected electron tube is non-active as an insulator. This non-active electron tube is in standby status for reverse current breaking if DC system changed its current flow direction. In this case this electron tube becomes active and the previously active one changes its status to non-active element automatically. In particular, each electron tube pair 11 comprises input means for receiving the electrical control signals, e.g. tripping the DC pole breaker 10. The control circuit 15 is thus provided with connection means for supplying the electron tube pairs 11 with the electrical control signals.

Each of the electron tube pairs 11 is thus controlled, and the electrical control signal is supplied to them by means electric wires from control circuit 15 to electron tube pairs 11.

What is claimed is:

1. A direct current breaker for a high voltage direct current application, the direct current breaker comprising:

two high voltage electron tubes arranged in an anti-parallel connection, each high voltage electron tube being provided with an anode and a cathode, and a control circuit for receiving, from a control system, infrared pulses comprising control information, and converting the infrared pulses into electrical control signals, for controlling a switching status of the direct current breaker.

2. The direct current breaker as claimed in claim 1, wherein, depending on a DC current flow direction, one electron tube is configured to be active and the other anti-parallel connected electron tube is configured to be non-active as an insulator.

3. The direct current breaker as claimed in claim 1, comprising two or more of the two high voltage electron tubes arranged in an anti-parallel connection connected in series.

4. The direct current breaker as claimed in claim 1, wherein the control circuit comprises an input device for receiving electrical power from an external power source.

5. The direct current breaker as claimed in claim 4, wherein the input device is arranged to convert AC power to a DC power or DC power to AC power needed by the control circuit.

6. The direct current breaker as claimed in claim 1, wherein the high voltage electron tubes comprise cold cathode electron tubes.

7. The direct current breaker as claimed in claim 1, wherein the high voltage current application comprises interruption of fault current of a voltage source converter or a thyristor based line commutated converter of an electrical power system.

8. An electrical power system comprising a voltage source converter and DC transmission lines, the electrical power system further comprising at least one direct current breaker as claimed in claim 1, the direct current breaker connected at one end to the voltage source converter and at another end to the transmission line.

9. The electrical power system as claimed in claim 8, further comprising a power source for supplying the direct current breaker with electrical power enabling conversion of infrared signals into electrical control signals.

10. The direct current breaker as claimed in claim 2, comprising two or more of the two high voltage electron tubes arranged in an anti-parallel connection connected in series.

11. The direct current breaker as claimed in claim 2, wherein the control circuit comprises an input device for receiving electrical power from an external power source.

12. The direct current breaker as claimed in claim 3, wherein the control circuit comprises an input device for receiving electrical power from an external power source.

13. The direct current breaker as claimed in claim 2, wherein the high voltage electron tubes comprise cold cathode electron tubes.

14. The direct current breaker as claimed in claim 3, wherein the high voltage electron tubes comprise cold cathode electron tubes.

15. The direct current breaker as claimed in claim 4, wherein the high voltage electron tubes comprise cold cathode electron tubes.

16. The direct current breaker as claimed in claim 5, wherein the high voltage electron tubes comprise cold cathode electron tubes.

17. The direct current breaker as claimed in claim 2, wherein the high voltage current application comprises interruption of fault current of a voltage source converter or a thyristor based line commutated converter of an electrical power system.

18. The direct current breaker as claimed in claim 3, wherein the high voltage current application comprises interruption of fault current of a voltage source converter or a thyristor based line commutated converter of an electrical power system.

19. The direct current breaker as claimed in claim 4, wherein the high voltage current application comprises interruption of fault current of a voltage source converter or a thyristor based line commutated converter of an electrical power system.

20. The direct current breaker as claimed in claim 5, wherein the high voltage current application comprises interruption of fault current of a voltage source converter or a thyristor based line commutated converter of an electrical power system.

* * * * *